US009982962B2

(12) United States Patent
Kras et al.

(10) Patent No.: US 9,982,962 B2
(45) Date of Patent: May 29, 2018

(54) AIR GUN WITH MULTIPLE ENERGY SOURCES

(71) Applicant: Sig Sauer, Inc., Newington, NH (US)

(72) Inventors: Krzysztof Kras, Fremont, NH (US); David C. Johnson, New London, NH (US)

(73) Assignee: SIG SAUER, INC., Newington, NH (US)

( * ) Notice: Subject to any disclaimer, the term of this patent is extended or adjusted under 35 U.S.C. 154(b) by 0 days. days.

(21) Appl. No.: 15/267,317

(22) Filed: Sep. 16, 2016

(65) Prior Publication Data

US 2017/0089664 A1 Mar. 30, 2017

Related U.S. Application Data

(60) Provisional application No. 62/232,481, filed on Sep. 25, 2015.

(51) Int. Cl.

| | |
|---|---|
| ***F41B 11/648*** | (2013.01) |
| ***F41B 11/64*** | (2013.01) |
| ***F41B 11/62*** | (2013.01) |
| ***F41B 11/723*** | (2013.01) |
| ***F41B 11/73*** | (2013.01) |

(52) U.S. Cl.

CPC ..... *F41B 11/648* (2013.01); *F41B 11/62* (2013.01); *F41B 11/723* (2013.01); *F41B 11/73* (2013.01)

(58) Field of Classification Search

CPC ..... F41B 11/64; F41B 11/642; F41B 11/648; F41B 11/72

USPC ..... 124/64–66, 69, 74, 73

See application file for complete search history.

(56) References Cited

U.S. PATENT DOCUMENTS

| | | | | |
|---|---|---|---|---|
| 1,214,398 A * | 1/1917 | Welch | F41B 11/72 | 124/69 |
| 2,652,821 A * | 9/1953 | Fitch | F41B 11/62 | 124/69 |
| 4,116,193 A * | 9/1978 | Chiba | F41B 11/50 | 124/51.1 |
| 4,148,245 A | 4/1979 | Steffanus et al. | | |

(Continued)

FOREIGN PATENT DOCUMENTS

| | | |
|---|---|---|
| CN | 2178796 Y | 10/1994 |
| CN | 1468693 A | 1/2004 |

(Continued)

*Primary Examiner* — Reginald Tillman, Jr.

(74) *Attorney, Agent, or Firm* — Finch & Maloney PLLC

(57) ABSTRACT

An air gun includes two different types of energy sources that may be used to fire a projectile. A first type of energy source may include an air cylinder having a piston that moves through a cylinder, as urged by a mechanical spring or gas strut, to create compressed air charge for firing a projectile. A second type of energy source may include a compressed gas storage tank that holds compressed air, or another propellant, that is released during firing to urge the piston through the air cylinder to create a compressed air charge for firing a projectile. An air gun may, additionally or alternately, include features that promote efficient delivery of a compressed air charge to a transfer port and projectile chamber, during firing. Examples of such features include piston configurations that reduce or prevent piston rebound through the interaction of the piston face and air cylinder, upon impact.

15 Claims, 12 Drawing Sheets

(56) References Cited

U.S. PATENT DOCUMENTS

| | | | | |
|---|---|---|---|---|
| 4,870,945 | A * | 10/1989 | Hutchison | F41B 11/645 124/64 |
| 5,193,517 | A | 3/1993 | Taylor et al. | |
| 5,341,790 | A * | 8/1994 | Ebert | F41B 11/62 124/69 |
| 5,363,834 | A * | 11/1994 | Stuchlik | F41B 11/62 124/69 |
| 5,727,538 | A | 3/1998 | Ellis | |
| 5,755,213 | A | 5/1998 | Gardner, Jr. et al. | |
| 5,884,615 | A | 3/1999 | Casas Salva | |
| 6,474,325 | B2 | 11/2002 | Rice et al. | |
| 6,516,791 | B2 | 2/2003 | Perrone | |
| 6,675,791 | B1 | 1/2004 | Alexander et al. | |
| 6,763,822 | B1 | 7/2004 | Styles | |
| 6,857,422 | B2 | 2/2005 | Pedicini et al. | |
| 6,957,645 | B1 * | 10/2005 | Cross | F41B 11/53 124/51.1 |
| 7,044,119 | B2 | 5/2006 | Jones | |
| 7,086,393 | B1 | 8/2006 | Moss | |
| 7,185,646 | B2 | 3/2007 | Jones | |
| 7,237,545 | B2 | 7/2007 | Masse | |
| 7,712,462 | B2 | 5/2010 | Pedicini et al. | |
| 7,730,881 | B1 | 6/2010 | Pedicini et al. | |
| 7,854,221 | B1 | 12/2010 | Gore | |
| 7,886,731 | B2 | 2/2011 | Masse | |
| 8,006,602 | B2 * | 8/2011 | Myrick | A62C 3/025 89/7 |
| 8,015,907 | B2 | 9/2011 | Tippmann, Sr. | |
| 8,074,632 | B2 | 12/2011 | Dobbins | |
| 8,100,120 | B2 | 1/2012 | Maeda | |
| 8,132,563 | B2 | 3/2012 | Gore | |
| 8,156,929 | B1 | 4/2012 | Gore | |
| 8,176,908 | B2 | 5/2012 | Dobbins | |
| 8,191,543 | B2 | 6/2012 | Masse | |
| 8,272,373 | B2 | 9/2012 | Masse | |
| 8,336,532 | B2 | 12/2012 | Masse | |
| 8,397,704 | B1 | 3/2013 | Gore | |
| 8,534,272 | B2 | 9/2013 | Dobbins | |
| 8,555,868 | B2 | 10/2013 | Dobbins | |
| 8,573,191 | B2 | 11/2013 | Dobbins | |
| 8,578,922 | B1 | 11/2013 | Granger | |
| 8,671,928 | B2 | 3/2014 | Hague et al. | |
| 8,739,770 | B2 | 6/2014 | Masse | |
| 2009/0007896 | A1 * | 1/2009 | Chung-Kuan | F41B 11/89 124/69 |
| 2014/0290637 | A1 * | 10/2014 | Maeda | F41B 11/62 124/74 |

FOREIGN PATENT DOCUMENTS

| | | | |
|---|---|---|---|
| CN | 201047733 | Y | 4/2008 |
| CN | 102107165 | A | 6/2011 |
| CN | 202141375 | U | 2/2012 |
| CN | 202780980 | U | 3/2013 |
| DE | 3812219 | A1 | 10/1989 |
| DE | 102006001214 | A1 | 1/2007 |
| EP | 0 844 456 | A2 | 5/1998 |
| WO | 98/27398 | A1 | 6/1998 |
| WO | 2011117661 | A1 | 9/2011 |

* cited by examiner

AIR GUN WITH MULTIPLE ENERGY SOURCES

RELATED APPLICATION

This application claims the benefit of U.S. Provisional Patent Application 62/232,481, filed Sep. 25, 2015, and entitled "AIR GUN WITH MULTIPLE ENERGY SOURCES," the entire disclosure of which is hereby incorporated by reference herein.

FIELD OF THE DISCLOSURE

The present disclosure relates to air guns, and more particularly, to an air gun having multiple energy sources for providing a compressed air charge for firing of a projectile from the air gun.

BACKGROUND

Compressed air powered guns or "air guns" utilize a compressed air charged to fire a projectile, such as a pellet, steel "bb" or dart. The projectile is loaded into a projectile chamber that is adjacent to or part of the air gun barrel. To fire the air gun, a compressed air charge is directed through a transfer port and into the projectile chamber. The air charge propels the projectile forward through and out of the muzzle end of the barrel toward a target.

Conventional air guns may include a mechanism to create the compressed air charge that is delivered to the projectile chamber for projectile firing. By way of example, some air guns include a piston that is movable in an air cylinder to provide the compressed air charge. Before firing, the piston is held in a cocked position against the force of an energized mechanical spring or gas strut. Upon firing, the piston is released and the mechanical spring or gas strut drives the piston through the air cylinder, compressing and delivering air from the cylinder and to the projectile chamber through the transfer port. After firing, a lever or other type cocking mechanism may be used to move the piston back to the cocked position for subsequent firing.

Other conventional types of air guns may use a compressed air charge that is held in a compressed air tank prior to firing of the air gun. When such air guns are fired (i.e., the trigger is released) fluid communication is opened between the compressed air tank and the projectile chamber to allow the release of compressed air and firing of a projectile. Such tanks may be sized to hold enough compressed air, or other propellant, to enable firing of multiple projectiles before the tank is refilled with compressed air. Some conventional air guns, often referred to as "pre-charged pneumatic" or "PCP" type air guns use compressed air tanks that are refilled by an external pump or a larger compressed air source, such as a SCUBA tank, to provide compressed air. Other conventional air guns may use a replaceable carbon dioxide charged cartridge to provide compressed gas for projectile firing.

SUMMARY

According to a first example embodiment, an air gun is disclosed. The air gun includes a barrel including a projectile chamber configured to receive a projectile. A transfer port is in fluid communication with the projectile chamber of the barrel and is constructed and arranged to deliver a compressed air charge to the projectile chamber to fire the projectile from the barrel of the air gun. The air gun has a cocking mechanism. A first energy source is movable to a cocked position by actuation of the cocking mechanism. The first energy source is constructed and arranged to provide at least a portion of the energy that provides the compressed air charge when released from the cocked position. A second energy source selectively provides at least another portion of the energy for further compressing the air charge to fire the projectile. In some cases, the second energy source is configured to be charged by a source external to the air gun. In some cases, the second energy source is a carbon dioxide cartridge or a compressed air cartridge. In some cases, the second energy source is a compressed gas tank. In some cases, the second energy source is sized for multiple shots by the air gun. In some cases, the first energy source includes a piston that is movable to the cocked position by actuation of the cocking mechanism. In some cases, the first energy source includes a gas strut configured to drive the piston for providing at least the portion of the energy for compressing the air charge when the first energy source is released from the cocked position. In some cases, the first energy source includes a mechanical spring configured to drive the piston for providing at least the portion of the energy for compressing the air charge when the first energy source is released from the cocked position. In some cases, the piston includes a cavity configured to house a granulated material that acts as a rebound buffer when the air gun is fired. In some cases, the piston includes a rounded face that conforms to a corresponding feature of the air gun for promoting delivery of the compressed air charge to the projectile chamber. In some cases, the air gun includes a grooved surface on one of the piston and the corresponding feature of the air gun for providing delivery of compressed air to the transfer port. In some cases, the air gun is configured to be operable in at least two different firing modes, including: a first firing mode where the energy used to compress the air charge includes energy provided by only the first energy source; and a second firing mode where the energy used to compress the air charge includes energy provided by the first energy source and the second energy source. In some cases, the cocking mechanism is configured to be actuated by at least one of breaking a breach of the air gun, a side lever, and an under lever. In some cases, the barrel and the projectile chamber are constructed and arranged to receive and fire a pellet. In some cases, the barrel and the projectile chamber are constructed and arranged to receive and fire a dart.

According to another example embodiment, an air gun includes a barrel having a projectile chamber configured to receive a projectile. A transfer port is in fluid communication with the projectile chamber of the barrel and is constructed and arranged to deliver a compressed air charge to the projectile chamber to fire the projectile from the barrel of the air gun. A cylinder includes a piston and is in fluid communication with the transfer port and projectile chamber. The piston is constructed and arranged to move through the cylinder to compress air for delivery to the transfer port and projectile chamber as the compressed air charge. The piston includes a forward face having a rounded surface that conforms to a corresponding cylinder surface of the cylinder to promote delivery of the compressed air charge to the transfer port. In some cases, at least one of the rounded surface and the corresponding surface is at least partially constructed of a conformable material. In such cases, the piston includes an elastomeric end portion with the rounded surfaced being formed in the elastomeric end portion. In some cases, the rounded surface includes a convex surface that conforms to a corresponding concave surface of the cylinder. In some cases, the piston and cylinder are constructed and arranged such that contact is initiated at an outer radial portion of the forward face as the forward face contacts the corresponding cylinder surface. In some cases, at least one of the forward face of the piston and the corresponding cylinder surface includes one or more grooves that are constructed and arranged to direct compressed air toward the transfer port. In some cases, the piston includes a cavity configured to house a granulated material that acts as a rebound buffer when the air gun firearm is fired.

The present disclosure is not intended to be limited to a system or method that must satisfy one or more of any stated objects or features. Modifications and substitutions by one of ordinary skill in the art are considered to be within the scope of the present disclosure.

BRIEF DESCRIPTION OF THE FIGURES

In the drawings, different embodiments of the invention are illustrated in which.

DETAILED DESCRIPTION

Figure 1:
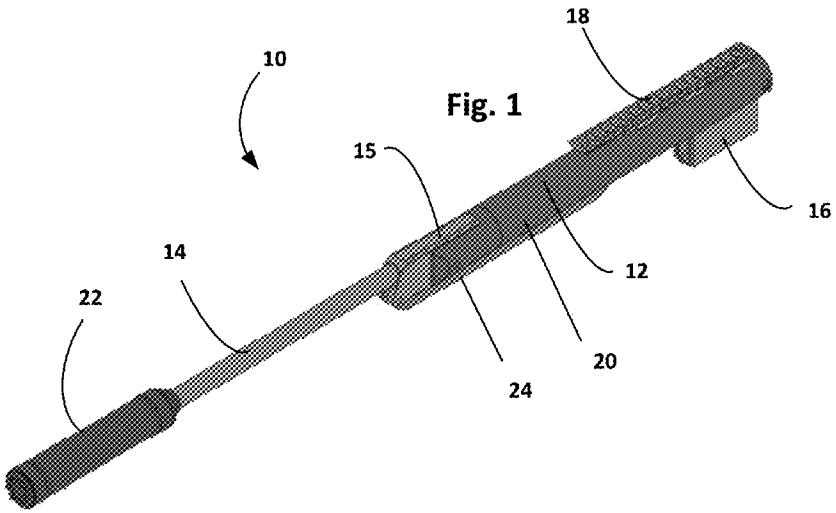
FIG. 1 shows a perspective view of an example embodiment of an air gun.

Air guns conventionally include a barrel and a projectile chamber located at a proximal end, or near a proximal end, of the barrel. The projectile chamber receives a projectile, such as a pellet, bb, or dart, that is propelled from a muzzle end of the barrel by an air charge when an operator fires the air gun. The propulsion may be accomplished by delivering the air charge from an air source, through a transfer port, and into the projectile chamber.

Air guns are conventionally constructed with a single energy source that provides compressed air for projectile firing. The applicant has appreciated that different types of energy sources provide various benefits. For example, air guns that utilize pre-charged pneumatic air tanks as an energy source may be fired repeatedly in a convenient manner, while the air tank contains adequate propellant. The same is true of air guns that use compressed carbon dioxide cartridges as an energy source. On the other hand, cartridges and tanks are not needed for air guns that use an air cylinder with a piston that is released from a cocked position during firing. The applicant has appreciated that combining multiple types of energy sources into a single air gun can leverage the advantages and benefits of each type of energy source.

According to some example embodiments, an air gun includes an air cylinder, a piston disposed within the air cylinder, and a barrel in fluid communication with the air cylinder. The piston moves through the air cylinder to compress air within the air cylinder during the firing process. The compressed air, in turn, is ejected into the barrel for propelling a projectile. The air gun includes two different types of energy sources for propelling the piston. A first type of energy source may include, for example, a compressed mechanical spring coupled to the piston or a gas strut such as used in conventional piston air guns. A second type of energy source may be selectively applied to the piston in conjunction with the first type of energy source, and may include, for example, a compressed gas storage tank that holds compressed air, or another propellant stored in a compressed or liquefied state. Upon firing, the compressed gas is released to move the piston that, in addition to the first energy source, compresses air that is used to fire the projectile. The gas storage tank may be removed and replaced to replenish the supply of compressed gas. Alternatively, the gas storage tank may be recharged with compressed gas by an external pump or charging tank.

Air guns, according to some example embodiments, can have multiple firing modes. A user can select which firing mode to use for any given shot. In a first firing mode, energy to provide a compressed air charge may, for example, be drawn solely from a mechanical spring or gas strut that energizes a cocked air cylinder, which is moved by force of a compressed spring. In a second mode, energy to provide the compressed air charge may, for example, be drawn from both the mechanical spring or gas strut and by a force provided by compressed gas received from a compressed gas storage tank. An operator may choose to fire an air gun in the second mode to draw energy from multiple sources when additional firing power is desired, such as when hunting game. The first mode may be selected when a lower energy shot is desired as well as to conserve compressed gas in the gas storage tank, such as during target shooting or plinking. Air guns, according to other example embodiments, may additionally or alternatively include one or more other firing modes, as will be appreciated in view of the present disclosure.

A dual energy source air gun, according to some embodiments, can deliver shots with more energy than from the amount of energy an operator applies to cock the air gun between shots alone. During cocking, the piston of an air cylinder-type air gun is moved against a mechanical spring or gas strut, which stores energy that is later released during firing. The amount of energy that can be stored by cocking the gun is often limited by the strength and endurance of the operator. By contrast, in accordance with various embodiments, a dual energy source air gun having a second, supplemental energy source that is independent of the cocking action between shots enables the air gun to achieve higher muzzle energy shots for the same amount of energy that an operator exerts to cock the gun.

Various example embodiments of air guns may also include features that promote efficient delivery of compressed air to a transfer port and projectile chamber, during firing. As will be appreciated, greater power can be achieved by an air gun with a more complete and/or efficient delivery of compressed air to the projectile during firing. The applicant has also appreciated that if and when the piston rebounds against the end of the air cylinder near the end of the firing cycle, a portion of the air charge in the gun barrel may be drawn back into the air cylinder, which can undesirably reduce the pressure of the air propelling the projectile. If the projectile has not already exited the muzzle end of the gun barrel, this reduced pressure may slow or otherwise disrupt the projectile. To this end, and in accordance with some embodiments, the air gun includes a piston having a cavity that houses weighted, granulated material that acts as a rebound buffer when the piston contacts the end face of the air cylinder, which minimizes or prevents rebound of the piston.

Example embodiments may, additionally or alternatively, reduce or prevent piston rebound with features that redirect forces resulting from piston contact with the end face of the cylinder wall. For example, the forward face of the piston, and the mating end face of the cylinder wall, may each include surfaces that are oriented at an angle with respect to the direction of motion of the piston. In this respect, at least a portion of any force that results from contact between the piston and cylinder end wall is directed perpendicular to the direction of motion of the piston. The surfaces may, in some cases, additionally be symmetrical about an axis in line with the direction of motion of the piston, such that forces resulting from contact between piston and end face of the cylinder act to balance or cancel one another, thus reducing or preventing rebound of the piston.

The forward face of the piston, and an opposing face of an end wall of the cylinder, can include features that direct compressed air to the transfer port in a controlled manner. According to some example embodiments, contact between the piston and end wall may begin at points further from the transfer port in the end wall and progress toward the transfer port, with advancement of the piston to the wall. In this respect, the progression of contact may prevent the formation of compressed air pockets between the piston and end wall, further promoting efficient and/or complete delivery of the compressed air charge to the transfer port. Additionally or alternatively, one or both of the forward faces of the piston and the end wall of the cylinder can include grooves that receive and promote movement of the compressed air charge toward the discharge port.

Figure 2:
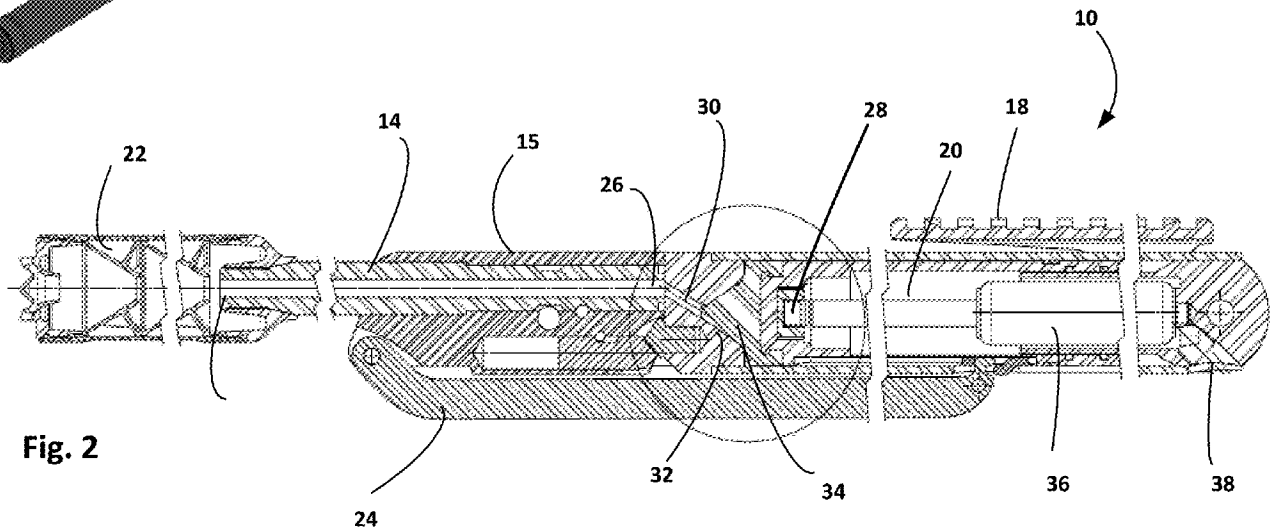
FIG. 2 shows a cross sectional view of the example embodiment shown in FIG. 1, taken along a central vertical plane with the air gun held in a horizontal position.

FIGS. 1 and 2 respectively show a perspective view of a portion of an air gun 10 and a cross sectional view of the air gun taken along a vertical plane that bisects the air gun with the barrel of the air gun. The air gun 10 includes a receiver 12 and a barrel 14. The receiver 12 includes a trigger mechanism 16, an accessory mount 18 and an air cylinder 20. The air cylinder 20 includes a piston 28 and a gas strut 36, mechanical spring or other mechanism for storing energy. The barrel 14 includes a muzzle end accessory 22, such as a sound moderator. A cocking mechanism 24 in the form of lever is connected to the barrel 14 and to the receiver 12. The cocking mechanism 24 moves the piston 28 within the air cylinder 20 to a cocked or compressed position when actuated by breaking a breach 15 of the air gun 10. In some embodiments, the cocking mechanism 24 may be actuated by, for example, a side lever, under lever or other form of mechanical linkage. The breach 15, when broken, also provides access to the projectile chamber 26 where a projectile (not shown) may be loaded for firing. The air gun 10 may include various other components, not shown, such as a stock, trigger, trigger guard, and hand guard.

Internal to the receiver 12 is a transfer port 30 that provides fluid communication between the air cylinder 20 and the projectile chamber 26. The transfer port 30 may, for example, have a small diameter (e.g., approximately ⅛ inch). The distal end of the piston 28 has an elastomeric end cap 34 with an integral seal 35. The gas strut 36 is configured to urge the piston toward an end face 32 of the air cylinder 20, adjacent to the transfer port 30. A vent port 38 on backside of the air cylinder 20 (i.e., the portion of the air cylinder behind the piston 28) provides fluid communication between the atmosphere and a volume inside the backside of piston 28 to allow venting of pressure/vacuum from the volume inside the backside of the piston 28 and to receive compressed gas into the volume inside the backside of the piston 28. The gas strut 36 is compressed by the cocking action, which forces the piston 28 rearward within the air cylinder 20. Likewise, the searing off action allows the gas strut 36 to move the piston 28 forward toward the end face 32 of the air cylinder 20, which creates a compressed air charge within the air cylinder 20. A supplemental propelling force can be selectively applied to the piston 28 by the compressed gas provided to the back of the piston 28 via the vent port 38. It will be understood that the air gun 10 can operate using the gas strut 36 alone or in combination with the supplemental compressed gas. It will be appreciated that FIGS. 1 and 2 show but one non-limiting example embodiment of an air gun 10, and that other configurations are contemplated and included within the scope of the present disclosure. For example, some examples of other embodiments include air guns having mechanical spring powered air cylinders/pistons and air guns with cocking mechanisms that are actuated with levers that are independent of any breach break in the air gun, to name a few.

FIGS. 3*a* to 3*h* include a progression of cross sectional views that show a firing cycle of the air gun 10 in a dual energy source mode, according to one example embodiment of the disclosure. The example embodiment of FIGS. 3*a*-3*h* includes a set of valves 40, 42, 44 that are actuated at various points throughout the firing cycle to perform desired functions. A venting valve 40 opens access between the atmosphere and the vent port 38 on the backside of the air cylinder 20 to allow air to be purged from the volume inside the backside of the piston 28 as the piston 28 with the end cap 34 move away from the end face 32 of the air cylinder during the cocking procedure. After cocking and closing of the breach, the venting valve 40 closes fluid communication between the volume inside the backside of the piston 28 and atmosphere to prevent the escape of compressed air during firing. In the illustrated embodiment, the venting valve 40 includes a normally closed, plunger operated, spring return valve, although other configurations of valves may alternately be used.

The set of valves also includes a manually actuated mode selector valve 42, according to the illustrated embodiment. The mode selector valve 42, when on, causes the air gun to draw compressed gas from a gas tank 46 to provide additional energy to move the piston 28 through the air cylinder 20 to provide a compressed air charge. When the mode selector valve 42 is off, fluid communication between the gas tank 46 and the port 38 of the air gun is closed throughout the firing cycle, such that the compressed air charge is formed solely from the movement of the piston 28 through the air cylinder 20 under potential energy of a gas strut 36 or mechanical spring. In the illustrated embodiment, the mode selector valve 42 includes a bi stable, lever operated valve, although other configurations may alternately be used. The gas tank may 46 include different types of compressed gas sources having the capacity to provide energy for multiple shots from the air gun, including but not limited to a replaceable, liquefied carbon dioxide cartridge and a rechargeable compressed air tank.

The set of valves further includes a gas tank valve 44 that may, for example, be cam (not shown) operated as the air gun moves through the firing cycle. When the mode selector 42 valve is open, the air tank valve 44 is actuated by a cam or other mechanism as the air gun is fired to release compressed gas from the gas tank to provide additional energy for propelling the piston 28 through the air cylinder. The additional energy helps generate greater pressures in shorter time in the compressed air charge, which is delivered through the transfer port 30 to the barrel 14 for firing a projectile. The gas tank valve 44 may also be opened during firing when the mode selector valve is closed, but in such instances the closed mode selector valve 42 will prevent compressed gas from escaping the gas tank and entering the volume inside the backside of the piston 28 through the vent port 38. In the illustrated embodiment the tank valve 44 is a normally closed, roller operated, spring return valve. Other types of valves such as a poppet type and actuating method like a hammer may alternately be used, as will be appreciated.

Figure 3A:
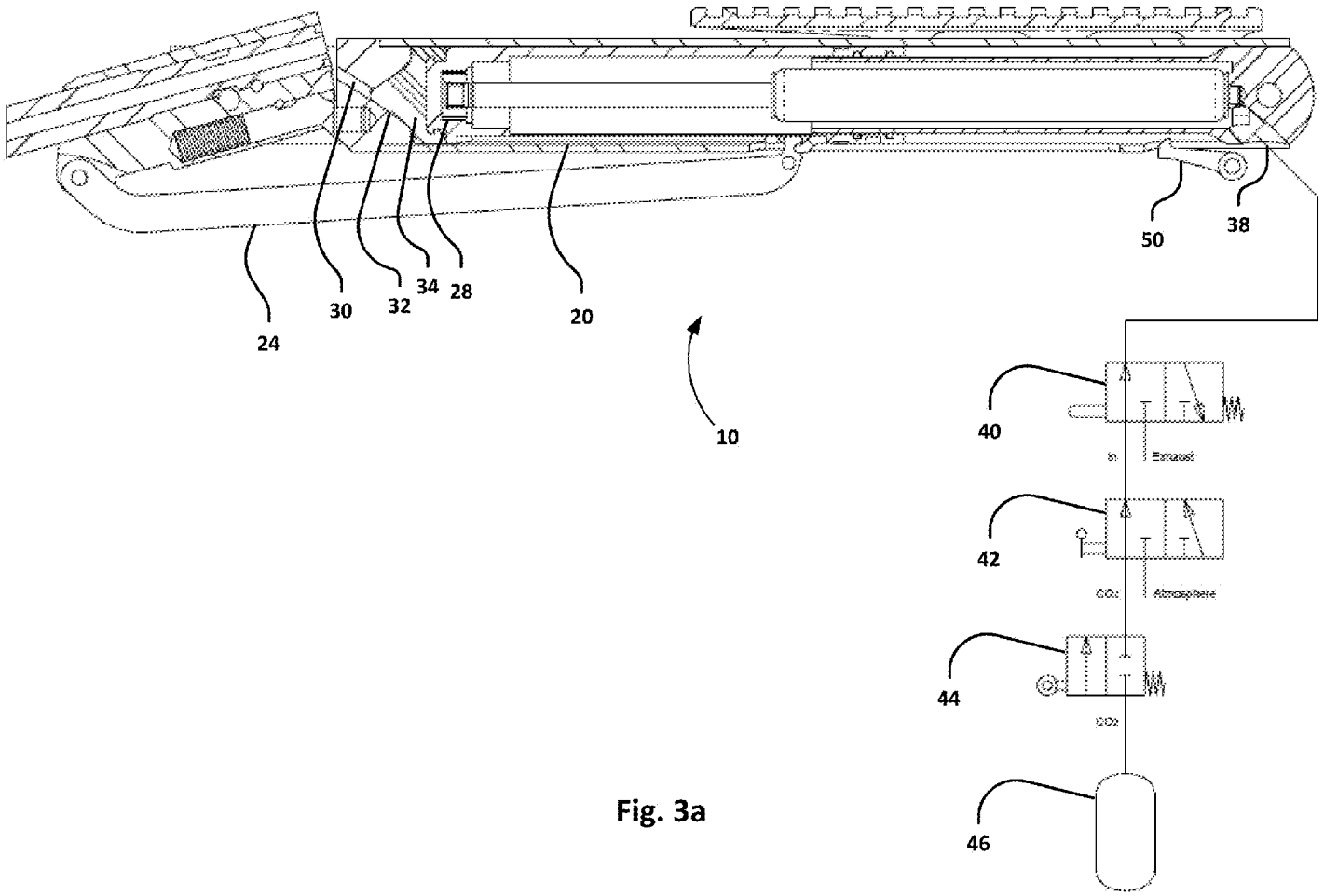
FIGS. 3*a*-3*i* show a cross sectional views of an air gun through various stages of a cocking and firing cycle, according to one example embodiment of the disclosure.

An example embodiment of the air gun 10 is shown at the initial stages of the cocking process in FIG. 3*a*. The breach of the air gun 10 has just been broken, unlocking the barrel from the receiver. The piston 28 is at the end of the piston stroke, with the face of the piston at or near the end face 32 of the air cylinder. In FIG. 3*a*, the mode selector valve 42 is in the open position, such that the air gun draws compressed air from the air tank when fired to provide additional firing energy. The vent valve 40 is positioned to provide fluid communication between the air cylinder 20 and gas tank 46 while the gas tank valve 44 is closed, due to positioning of cam, preventing the escape of compressed gas from the gas tank 46.

Figure 3B:
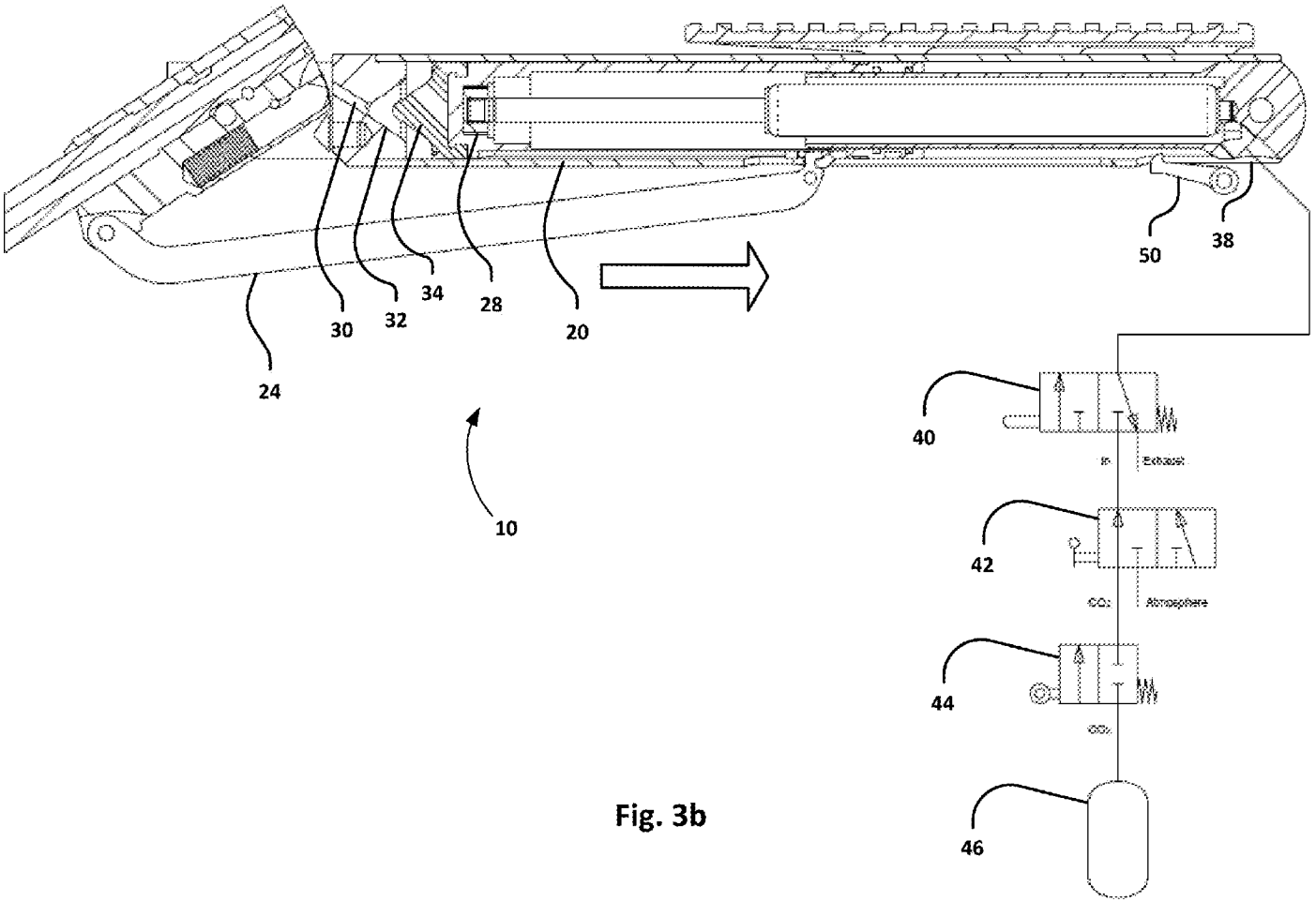
Figure 3C:
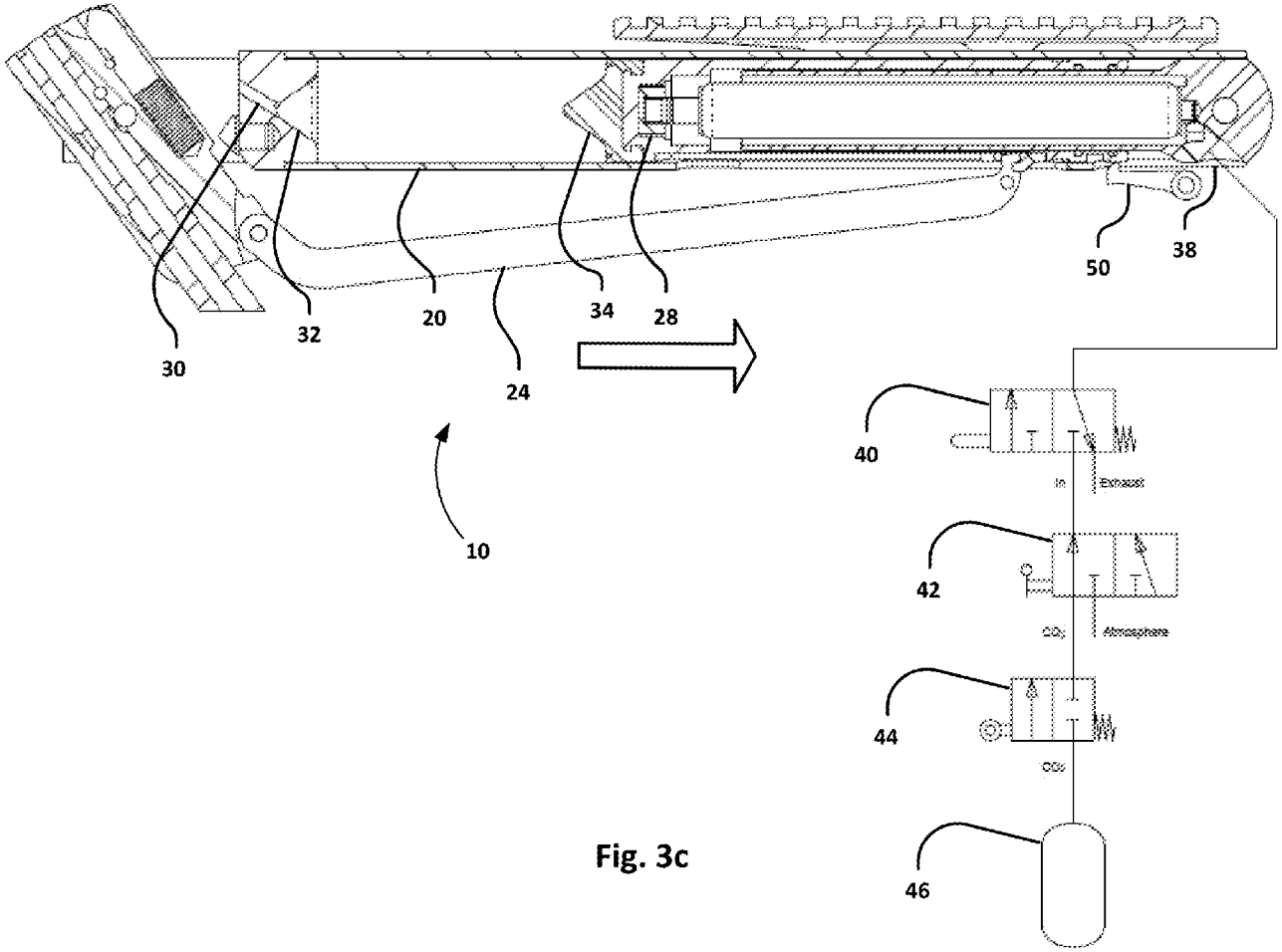

FIG. 3*b* shows the air gun 10 as the cocking process has progressed. The vent valve 40 is moved to the open position, allowing gas to evacuate from the volume inside the backside of the piston 28 to the atmosphere, thus preventing pressure from building therein as the piston 28 moves away from the end face 32 of the air cylinder. The operator applies continued force to break the breach of the air gun 10, as shown in FIG. 3*c*, through the cocking mechanism 24. This application of force causes the piston 28 to move further away from the end face 32 of the cylinder 20. In the illustrated example embodiment, the piston 28 is urged against a force provided by a gas strut 36, although other mechanisms are also contemplated, including but not limited to a mechanical spring.

Figure 3D:
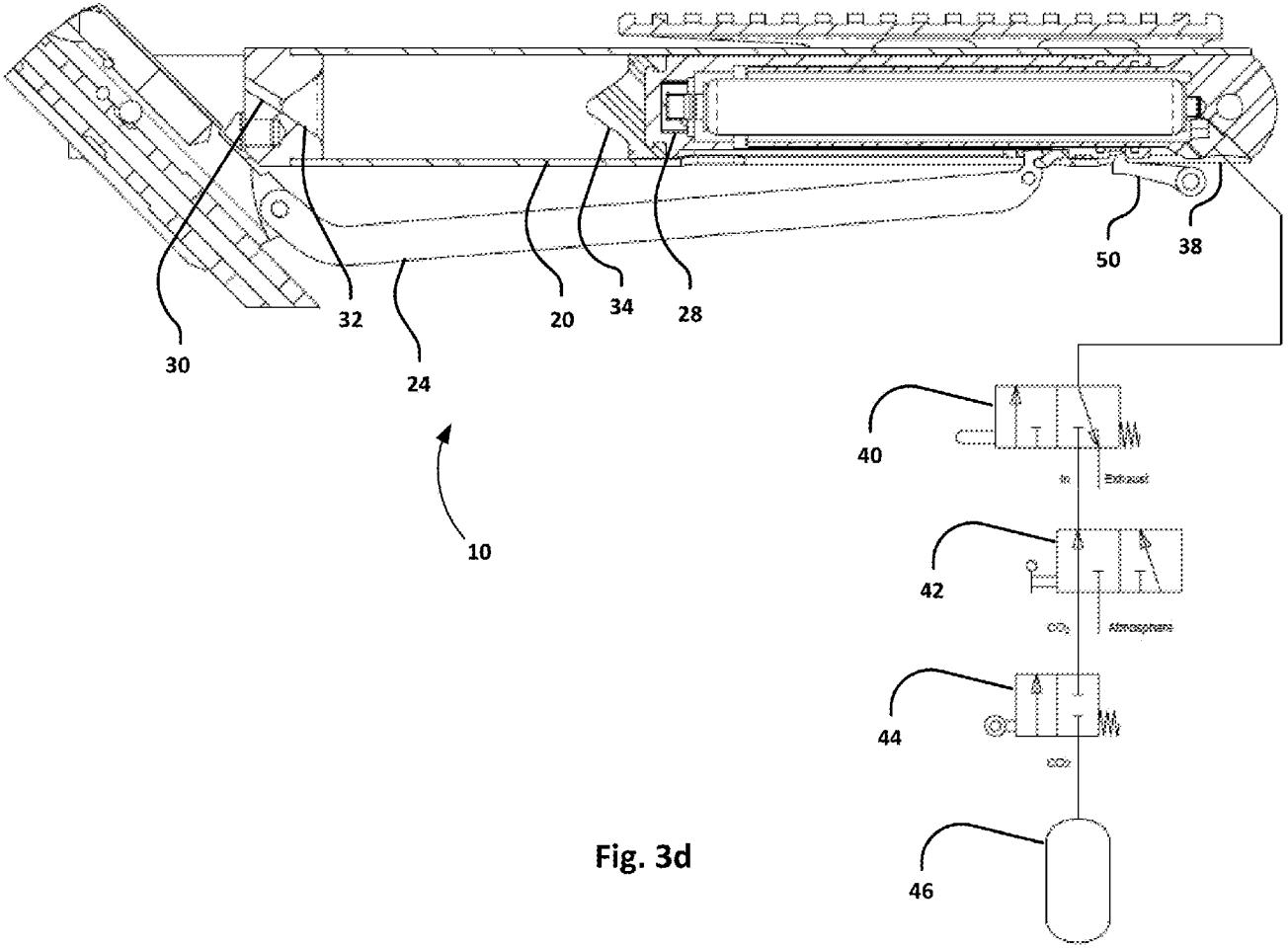
Figure 3E:
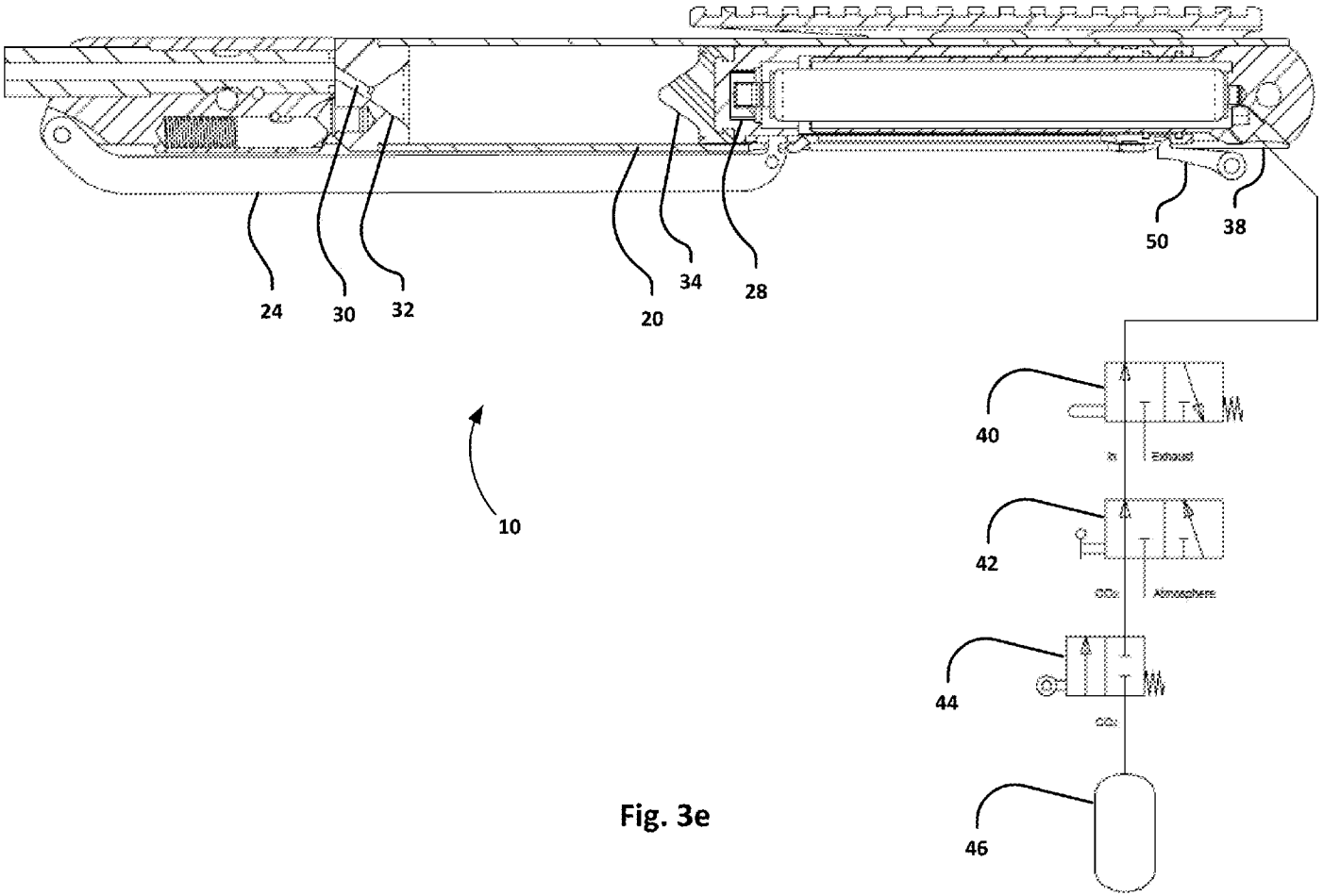

The piston 28 of the air cylinder 20 is locked or "seared" in the cocked position by a sear 50 when the end of travel is reached, as shown in FIG. 3*d*. The air gun 10 is shown in a cocked configuration. The breach remains open and an operator may typically load a projectile into the projectile chamber of the air gun 10 at this point in the firing cycle. With projectile loaded into the projectile chamber, the breach of the air gun 10 may be closed and the barrel locked, as shown in FIG. 3*e*. As the breach of the air gun 10 is closed, the vent valve 40 is also closed, thereby sealing the volume inside the backside of the piston in the air cylinder off from the atmosphere. In this position, the air gun is ready for firing.

Figure 3F:
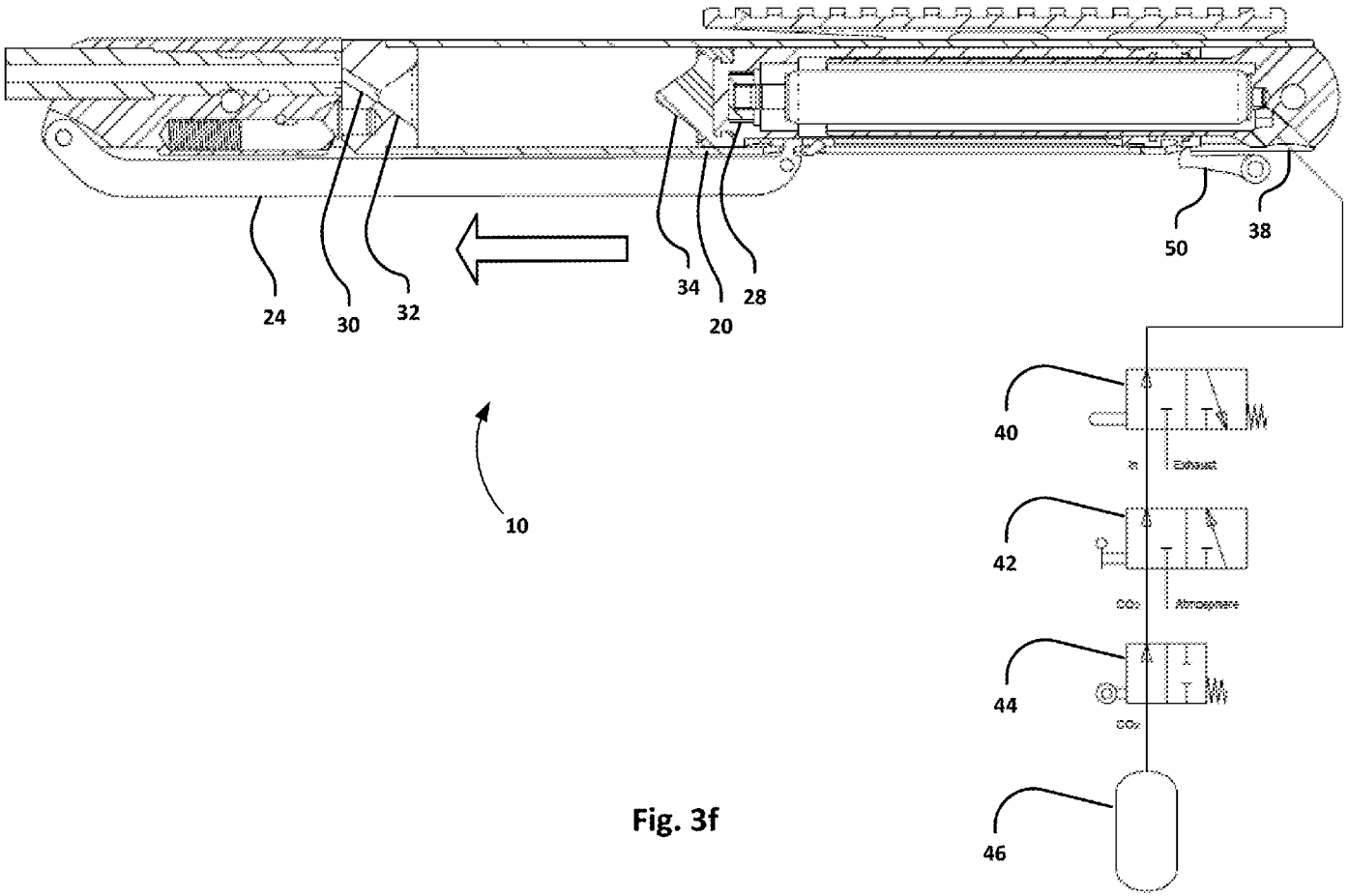
Figure 3G:
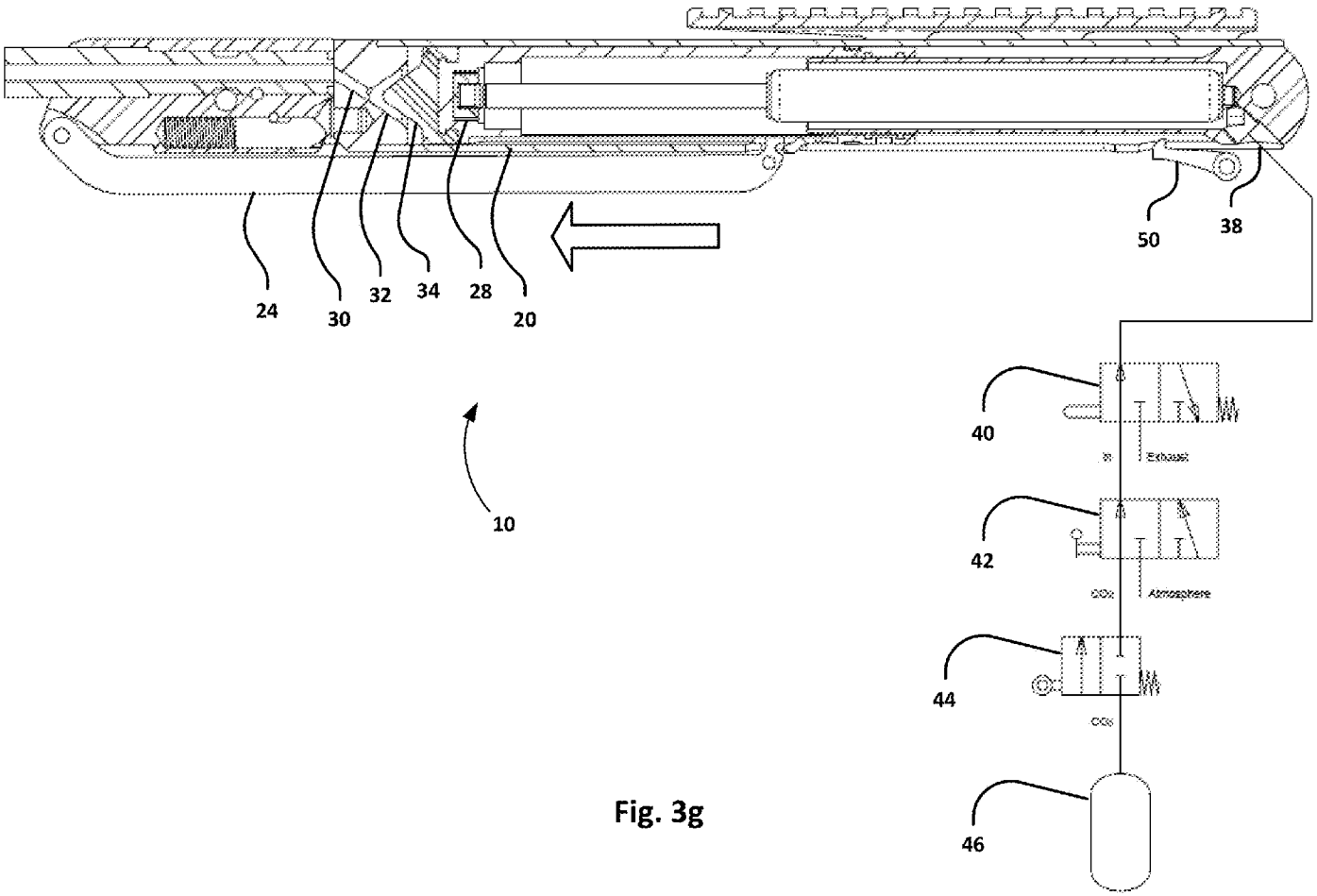
Figure 3H:
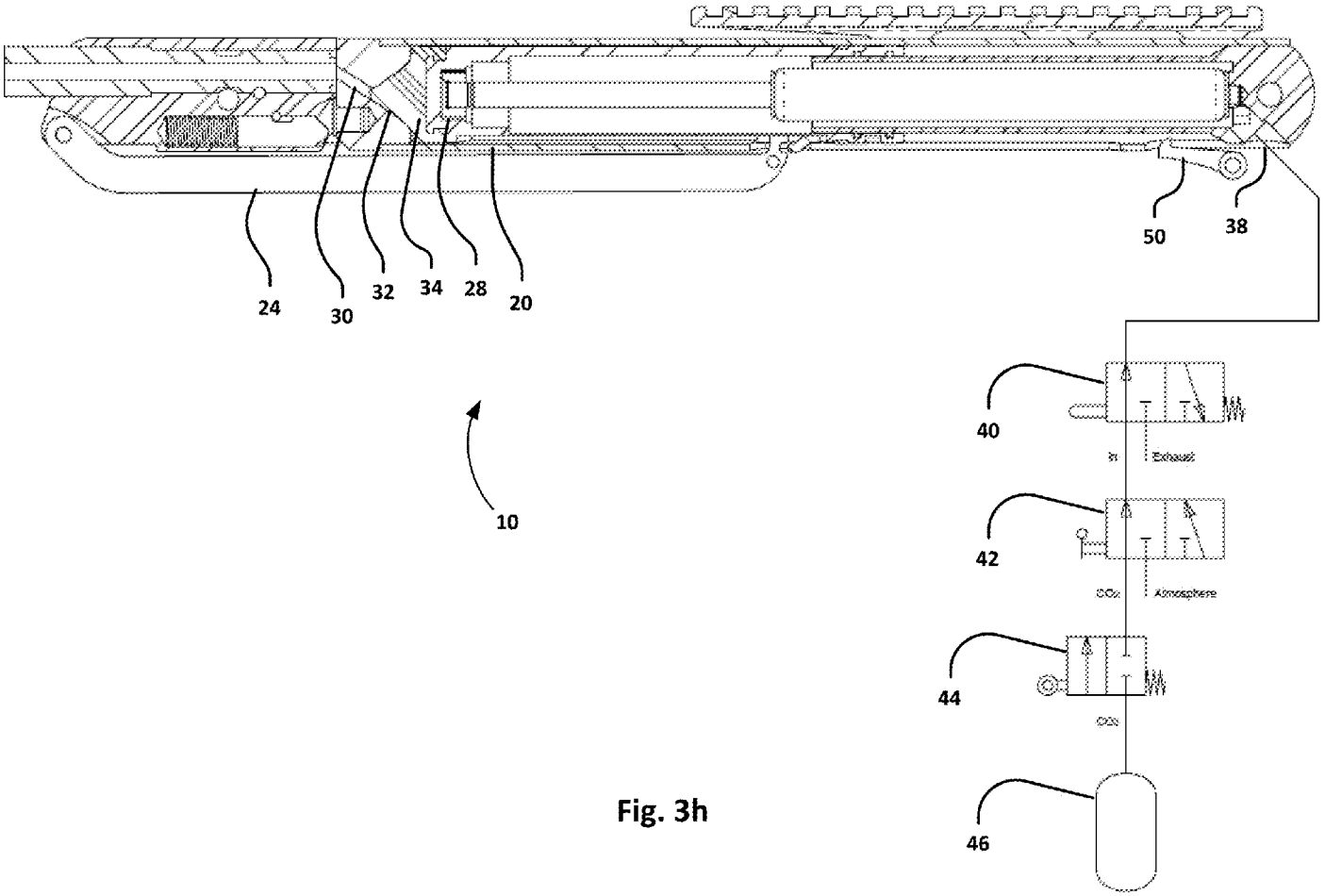

Pulling the trigger of the air gun 10 causes the sear 50 to release the piston of the air cylinder, as shown in FIG. 3*f* The piston 28 then moves forward, through the air cylinder 20, compressing any air therein and directing the air through the transfer port 30 and to the projectile chamber to propel the projectile from the barrel 14. As the piston 28 starts its progression toward the end face 32 of the air cylinder 20, a cam acts on the roller (not shown) of the gas tank valve 44 to open fluid communication between the gas tank 46 and the volume inside the backside of the piston 28 in the air cylinder 20. At this point, the gas tank 46 provides an additional boost of compressed gas that contributes to propelling the piston 28 forward in the air cylinder 20 and thus to compressing the air charge that propels the projectile from the air gun 10. As the piston progresses further toward the end face of the air cylinder, the cam moves away from the roller of the air tank valve 44 and allows the normally closed gas tank valve 44 to return to the closed position, as shown in FIG. 3*g*. The firing cycle ends when the piston end cap 34 reaches the end face 32 of the cylinder 20 and the projectile leaves the muzzle. The firing cycle may then be repeated by breaking the breach of the air gun, as shown in FIG. 3*a*.

When an operator desires to turn off the second energy source (e.g., tank of compressed gas), the manual selector valve 42 is moved to the closed position. The firing and cocking cycle shown in the progression of FIGS. 3*a* to 3*h* is similar, under such circumstances, except that release of compressed gas from the gas storage tank is prevented by the positioning of the gas tank valve 44. This results in piston 28 moving distally through the air cylinder 20 solely under the power of the gas strut 36 or mechanical spring, while drawing atmospheric air into the volume inside the backside of the piston via the vent port 38 supplied by valves 40 and 42.

Figure 3I:
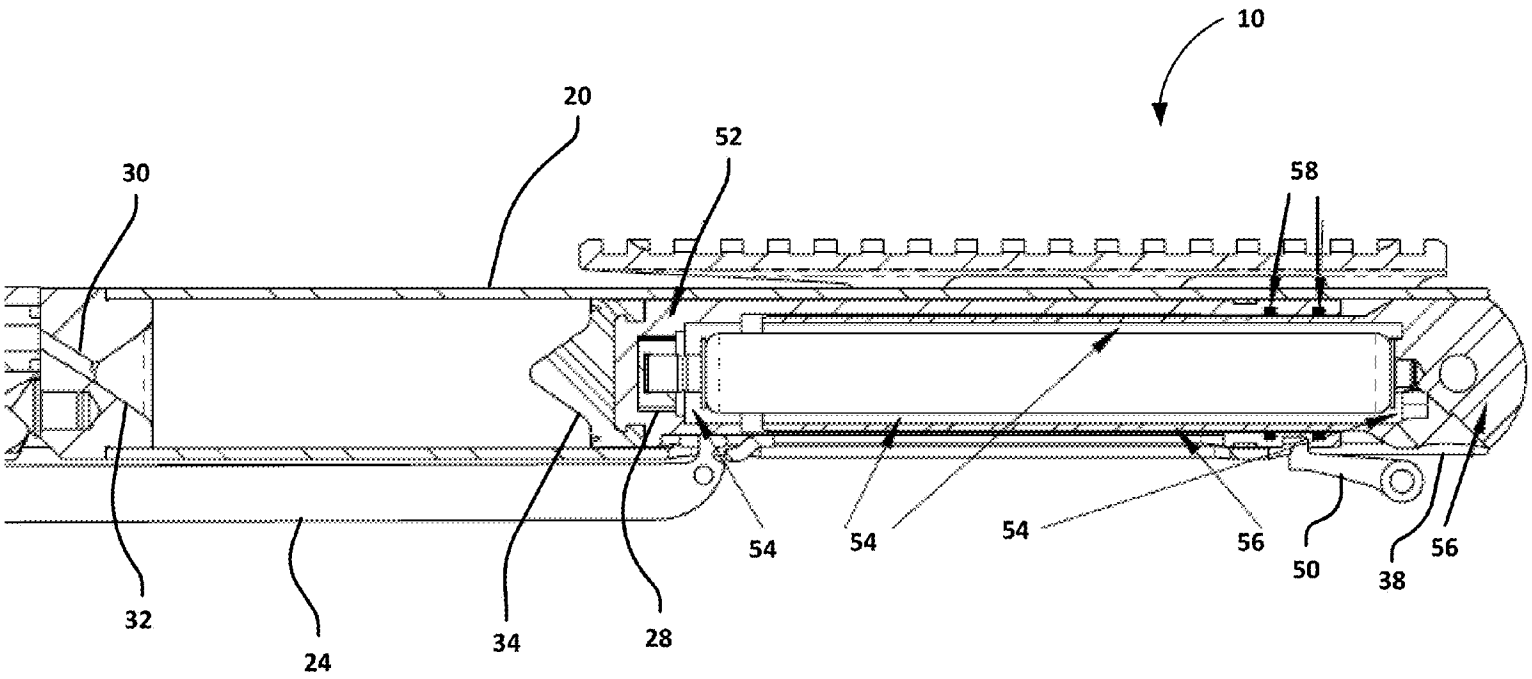

FIG. 3*i* shows a more detailed side view of a portion of the air gun 10, in accordance with an embodiment. In this embodiment, the piston 28 itself forms a cylinder 52 (e.g., within the air cylinder 20). The piston cylinder 52 has an internal volume 54 (i.e., on the backside of the piston head 28) that can contain a gas provided by the second energy source via the vent port 38. The gas may, for example, be atmospheric air or carbon dioxide. The piston cylinder 52 is disposed within a piston cylinder guide shaft 56 (or cylinder rod). The piston cylinder 52 is sealed with one or more seals 58 (e.g., O-rings or other suitable sealing materials) for sealing the volume 54 during the transfer of compressed gas from the second energy source to the piston cylinder. In this manner, the compressed gas within the volume 54 provides a supplemental force for moving the piston 28 toward the end face 32 of the air cylinder 20 when the air gun 10 is fired.

Figure 4:
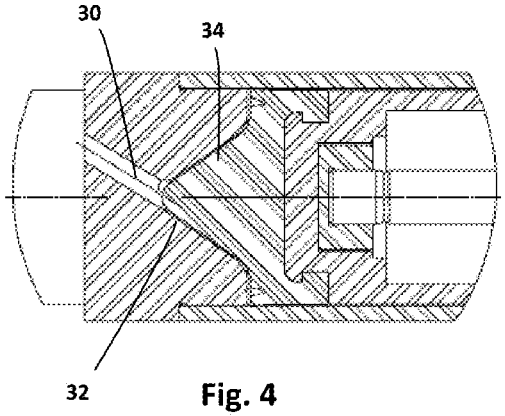
FIG. 4 is a close up view of the forward face of the piston and the end face of the air cylinder of the example embodiment of FIG. 1.
Figure 6:
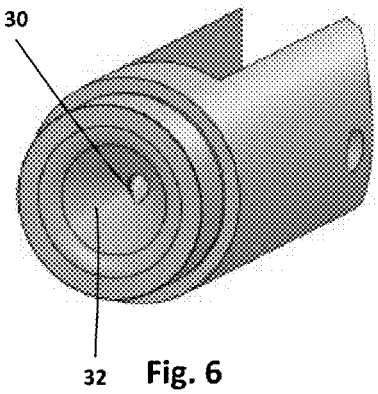
FIG. 6 is a perspective view of an end face of an air cylinder, according to the example embodiment shown in FIG. 4.
Figure 8B:
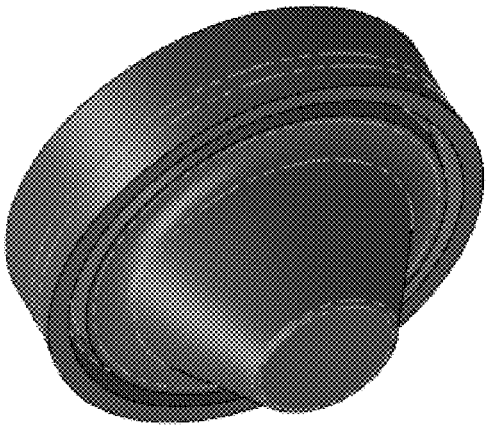
FIGS. 8*a* and 8B are perspective views of an end face of an air cylinder and a piston end cap, according to one example embodiment of the disclosure.
Figure 8A:
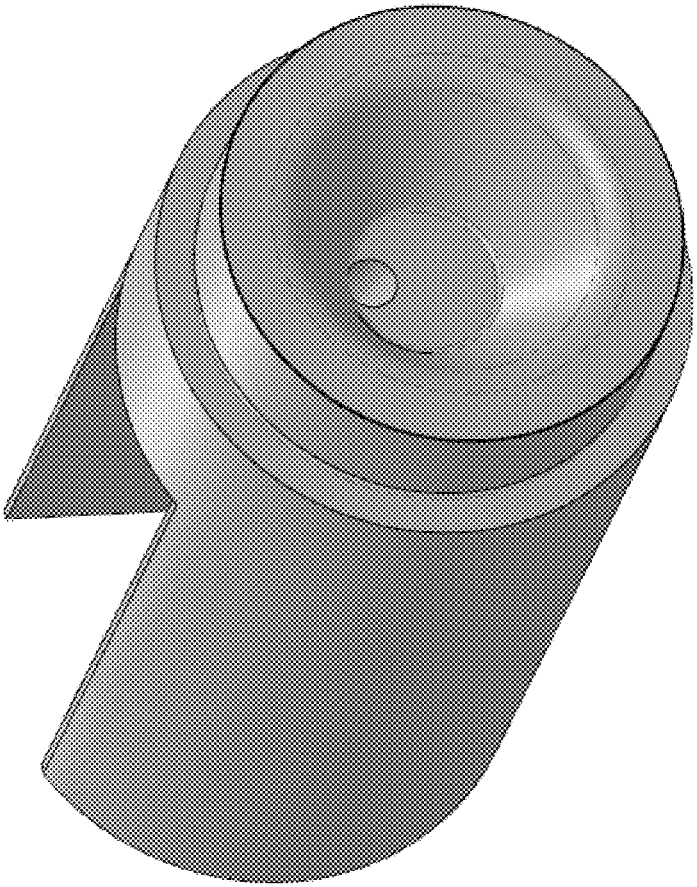

In accordance with some embodiments, an interface between the piston 28 and the end face 32 of the air cylinder 20 may include features that promote a more complete and/or efficient delivery of compressed air to the projectile chamber through the transfer port 30. By way of example, FIG. 4 shows piston with a forward face 33 that has a convex, rounded surface that can abut a corresponding surface at an end face 32 of the air cylinder 20 when the piston 28 is fully extended. As illustrated, the end face has a somewhat rounded, concave surface, as shown in FIG. 6 that receives the piston centrally about the transfer port. Other configurations of pistons and air cylinders are also contemplated, including pistons that have a concave forward face and air cylinders that have a convex end face, among other configurations. For example, FIGS. 8*a* and 8*b* show another example embodiment in which the cylinder end and corresponding piston end cap with an integral seal, respectively, have a concave section with a flat bottom. In some example cases, the included angle of the concave/convex surfaces may be between about 30 degrees and 120 degrees. In some other examples, the shapes of the surfaces can be conical or paraboloidal.

With some conventional air piston air guns, rebound forces during an impact between a flat faced piston and cylinder contact are predominantly axial, resulting in substantial rebound of the piston. This reverse movement of the piston creates a volume in the cylinder that is filled with a compressed air from a barrel, resulting in decrease of the air pressure propelling a pellet forward in the barrel. To this end, and in accordance with an embodiment of the present disclosure, an inclined contact surface of a forward face of a piston and a matching concave surface of an end face of a cylinder result in contact forces that lay on a substantial angle relative to the center axis of the cylinder, both of which have axial and radial components. Unlike the pure axial rebound forces in conventional air guns, the presence of radial forces leads to a decrease in the axial rebound energy. Additionally the collision forces normal to the contact surfaces result in friction between the piston end cap 34 and the end face 32 of the cylinder 20 and an additional wedging action that further dissipates the impact energy. This interaction of the piston and cylinder faces upon impact reduces or prevents piston rebound upon impact leading to improved efficiency of an air rifle in accordance with various embodiments.

Figure 5:
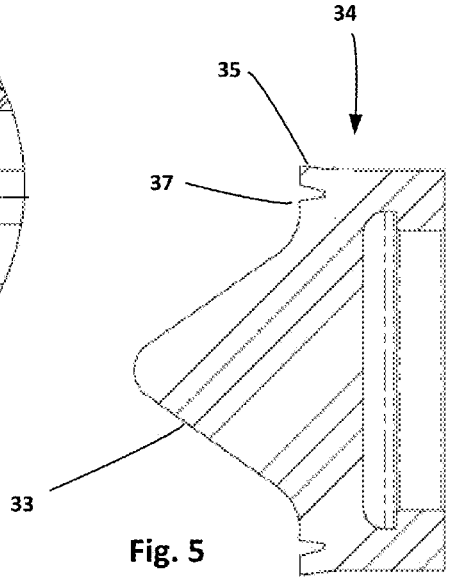
FIG. 5 is a cross sectional view of a piston end cap, according to the example embodiment shown in FIG. 4.

The forward face 33 of the piston and/or the end face 32 of the air cylinder may be constructed of a material that prevents rebound. In the example embodiment of FIG. 4, the piston includes an end cap 34, as shown separately in FIG. 5, made of a polymer material that softens any blow by absorbing energy when the piston contacts the end face of the cylinder, as shown in FIG. 6, during firing. Energy associated with impact between the piston and end face may, at least partially, be dissipated as heat by the polymer material. The material may, additionally or alternately, act to quiet any sound associated with the piston contacting the end face, as may be desirable for air gun operation.

The forward face of the piston 28 and the end face 32 of the air cylinder 20 may be constructed such that contact between these components acts to direct air towards the transfer port 30, according to some example embodiments. This can help prevent air pockets from occurring, promoting a more complete delivery of compressed air to the transfer port 30 and projectile chamber. In the example embodiment of FIG. 5, the forward face 33 of the piston includes a ring 37 positioned near a radially, outermost edge and that is constructed to contact the end face 32 of the air cylinder 20 ahead of any other portions of the piston 28. After initial contact is made by the ring 37, further contact is made progressively at points closer to the center of the forward face with final contact between the forward face and end face being made near the transfer port 32. In this respect, air within the air cylinder 20 is progressively driven to the transfer port 32 in a manner that prevents the formation of air pockets.

Figure 7:
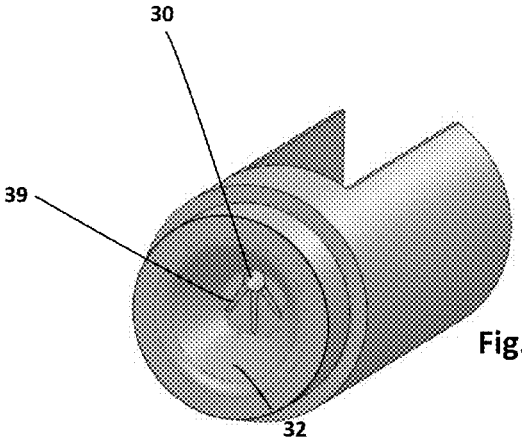
FIG. 7 is a perspective view of an end face of an air cylinder, according to one example embodiment of the disclosure.

FIG. 7 shows an example embodiment of an air cylinder end face 32 and a forward face 33 of the piston 28 that includes shorter concave and convex surfaces, respectively. This design terminates with a flat bottom and allows for the transfer port to be located off center, in close proximity to the outer edge of the circular bottom face. Placing the transfer port 30 off center can reduce an overall angle of the transfer port and provide for a more gradual flow of compressed air between the cylinder bottom and the chamber in the barrel. A flat bottom of the cylinder with the entrance to the transfer port may include a grooved 39 surface to prevent any air pockets from forming on the flat surface and promote delivery of compressed air to a discharge port 30. The grooves 39, as illustrated, lie in a central area of the end face 32 and extend radially away from the discharge port 30. It is to be appreciated that other configurations are possible and are contemplated, including grooves that extend further away from the discharge port and, among other variations, grooves that are positioned in the forward face of the piston.

The piston of an air cylinder may, additionally or alternatively, include a granulated buffer material that moves with the piston, in a delayed manner, to buffer any rebound of the piston upon impact. According to one example embodiment (not shown) a piston includes a hollow cavity that encloses weighted and granulated buffer material. The material follows the piston toward the end face of the air cylinder and, at a time when the piston might experience rebound, contacts an interior wall of the cavity to counteract any rebound forces, thereby preventing rebound.

While several embodiments have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of this disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of this disclosure is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, along with other embodiments that may not be specifically described and claimed.

All definitions, as defined herein either explicitly or implicitly through use should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. An air gun, comprising:

a barrel including a projectile chamber configured to receive a projectile;

a transfer port in fluid communication with the projectile chamber of the barrel, the transfer port configured to deliver a compressed air charge to the projectile chamber for firing the projectile from the barrel of the air gun;

a cocking mechanism;

a manually activated mode selector valve;

a first energy source movable to a cocked position by actuation of the cocking mechanism, the first energy source configured to provide at least a portion of the energy for compressing the air charge when released from the cocked position; and a second energy source configured to selectively provide, via the manually activated mode selector valve, at least another portion of the energy for further compressing the air charge.

2. The air gun of claim 1, wherein the second energy source is configured to be charged by a source external to the air gun.

3. The air gun of claim 2, wherein the second energy source is one of a carbon dioxide cartridge and a compressed air cartridge.

4. The air gun of claim 2, wherein the second energy source is a compressed gas tank.

5. The air gun of claim 2, wherein the second energy source is sized for multiple shots by the air gun.

6. The air gun of claim 1, wherein the first energy source includes a piston that is movable to the cocked position by actuation of the cocking mechanism.

7. The air gun of claim 6, wherein the first energy source includes a gas strut configured to drive the piston for providing at least the portion of the energy for compressing the air charge when the first energy source is released from the cocked position.

8. The air gun of claim 6, wherein the first energy source includes a mechanical spring configured to drive the piston for providing at least the portion of the energy for compressing the air charge when the first energy source is released from the cocked position.

9. The air gun of claim 6, wherein the piston includes a cavity configured to house a granulated material that acts as a rebound buffer when the air gun is fired.

10. The air gun of claim 6, wherein the piston includes a rounded face that conforms to a corresponding feature of the air gun for promoting delivery of the compressed air charge to the projectile chamber.

11. The air gun of claim 10, further comprising a grooved surface on one of the piston and the corresponding feature of the air gun for providing delivery of compressed air to the transfer port.

12. The air gun of claim 1, wherein the air gun is configured to be operable in at least two different firing modes, including:

a first firing mode where the energy used to compress the air charge includes energy provided by only the first energy source; and a second firing mode where the energy used to compress the air charge includes energy provided by the first energy source and the second energy source.

13. The air gun of claim 1, wherein the cocking mechanism is configured to be actuated by at least one of breaking a breach of the air gun, a side lever, and an under lever.

14. The air gun of claim 1, wherein the barrel and the projectile chamber are constructed and arranged to receive and fire at least one of a pellet and a dart.

15. The air gun of claim 1, wherein the manually activated mode selector valve is configured, when on, to open fluid communication between the second energy source and the transfer port and, when off, to close fluid communication between the second energy source and the transfer port.

* * * * *